US005085146A

United States Patent [19]

Baginski

[11] Patent Number: 5,085,146

[45] Date of Patent: Feb. 4, 1992

[54] ELECTROEXPLOSIVE DEVICE

[75] Inventor: Thomas A. Baginski, Auburn, Ala.

[73] Assignee: Auburn University, Auburn, Ala.

[21] Appl. No.: 525,334

[22] Filed: May 17, 1990

[51] Int. Cl.[5] ..... F42B 3/13

[52] U.S. Cl. ..... 102/202.5

[58] Field of Search ..... 102/202.1, 202.2, 202.4, 102/202.5, 202.7, 202.9

[56] References Cited

U.S. PATENT DOCUMENTS

| | | | |
|---|---|---|---|
| 3,198,117 | 8/1965 | Purdy et al. | 102/202.4 |
| 3,211,096 | 10/1965 | Forney et al. | 102/202.5 |
| 3,366,055 | 1/1968 | Hollander, Jr. | 102/202.7 |
| 3,882,324 | 5/1975 | Smolker et al. | 102/202.5 |
| 4,484,523 | 11/1984 | Smith et al. | 102/202.5 |
| 4,708,060 | 11/1987 | Bickes, Jr. et al. | 102/202.7 |
| 4,819,560 | 4/1989 | Patz et al. | 102/202.5 |
| 4,893,563 | 1/1990 | Baginski | 102/202.2 |
| 4,967,665 | 11/1990 | Baginski | 102/202.2 |

*Primary Examiner*—Charles T. Jordan
*Attorney, Agent, or Firm*—Thad G. Long

[57] ABSTRACT

An electroexplosive device utilizing dielectrics and semiconductors of various configurations, which is of compact size, resistant to breakage, extremely reliable, shielded from accidental ignition resulting from stray RF signals and accidental electrostatic discharge, and the firing characteristics of which may be conveniently varied to achieve desired performance objectives.

8 Claims, 1 Drawing Sheet

ELECTROEXPLOSIVE DEVICE

BRIEF SUMMARY OF THE INVENTION

Within a broad variety of ordnance systems there exists an interface which utilizes electrical energy to initiate an exothermic reaction (i.e., heating, ignition, combustion, explosion) and/or a mechanical shock wave. The device which acts as the interface is referred to as an electroexplosive device (EED). In its simplest form, the device consists of a thin resistive wire (bridgewire) suspended between two posts which are connected to lead wires. The bridgewire is surrounded by a flammable compound referred to as the mix. To initiate combustion of the compound, a DC, or very low frequency AC, current is injected through the bridgewire which heats the wire through standard resistance heating. When the wire reaches the ignition temperature of the mix, combustion/detonation occurs.

Over the past four decades the electromagnetic environment of EEDs has changed dramatically, and as an obvious consequence, the associated electromagnetic interference (EMI) problems as well. The necessary operation of high-power radar and communication equipment in the proximity of EEDs (e.g. aircraft carrier flight deck) has resulted in a typical operating environment that includes high-intensity electromagnetic fields and the possibility of intermittent radio frequency (RF) induced arcing.

High-intensity RF fields associated with the EEDs' environment present a serious EMI compatibility problem. These fields can couple electromagnetic energy through either a direct or indirect path to an EED and cause accidental ignition. Typical examples of these two types of EMI problems occur when RF radiation is incident on the device's chassis (i.e. the EED acts as the load of a receiving antenna) or when RF induced arcing takes place in the vicinity of the ordnance and couples energy of the EED (e.g., via a conducting umbilical cable).

An RF induced arc-over (discharge) results whenever sufficient electrical energy (charge accumulation) is present across an air gap to initially ionize the gas and sustain an ionized channel.

The electrical stimuli received by EEDs located in the vicinity of intense RF fields (e.g. naval surface ships) may contain signal components due to rectification of RF radiation. Rectification of RF radiation on ships is due to simple metal contact diode action. This is generally caused by corrosion of contacts or incorrectly connected fasteners. The rectified signal may have signal components that are at much lower frequencies than the source RF radiation and also contain a DC component, any of which may couple to the EED and cause ignition.

Another potential hazard of EEDs involves the coupling of an electrostatic discharge (ESD) to the element. Electrostatic discharge is characterized as coupling a signal which is of a high voltage and fairly low energy. The energy of the event is usually insufficient to cause any significant ohmic (resistance) heating of the EED. However, the high induced voltage can create an intense enough electric field between input pins of the igniting device and surrounding casing to result in combustion of the pyrotechnic.

The first method of solving a given EMI problem usually involves the installation of one or more passive filters. Several standard types of passive filters exist which can be utilized to attenuate stray RF signals. These filters can usually be classified as either L, Pi, or T types, or as combinations of each, and have historically been used as a first measure of eliminating EMI problems.

Spark gap arresters are a common method of alleviating ESD problems. A spark gap essentially consists of two conductive electrodes which are precisely separated via an air gap. Whenever an electric field is imposed across the conductors which exceeds the dielectric strength of the air, breakdown occurs and allows for the free transfer of excess charge across the gap. Usually the electrode which has charge transferred to it is connected to ground and in this fashion the arrester directs charge away from any sensitive elements.

A variety of EEDs have been configured which utilize passive filters and/or spark gap arresters to protect the bridgewire. There exists a lengthy history of such configurations.

A shielded initiator is described by Maurice Apstein and Arthur O. Morse in U.S. Pat. No. 2,821,139 (1958). The configuration consists of a low pass single stage filter which is realized by providing a dielectric shunt between the input leads of the device followed by a lossy magnetic material.

A protective RF attenuator plug for wire-bridge detonators is described by Theodore Warshall in U.S. Pat. No. 3,572,247 (1971). The configuration consists of a conventional bridgewire which is protected by a multiple stage low pass filter. The geometry of the filter is such that it replaces the plastic base plug found in most EEDs.

A filtered electroexplosive device is described by William Hudson in U.S. Pat. No. 3,735,705 (1973). The configuration consists of a high pass, lossy, ceramic filter on the connector pin of the device. The structure acts to shunt RF signals to case.

A filtered assembly is disclosed by Tadashi Yajima et al. in U.S. Pat. No. 4,271,453 (1981). The assembly provides a switch and a filter arranged in a precise manner. The switch closes upon removal of a specified connector in such a fashion as to provide an electrical short for an ESD event. The assembly also contains a filter to shunt RF to case.

Electromagnetic and electrostatic insensitive blasting caps, squibs and detonators are described by Paul Proctor in U.S. Pat. No. 4,378,738 (1983). The device consists of a ferrite bead attenuator to limit the amount of RF reaching the bridgewire of the structure used in conjunction with a resistive tape which connects the input leads together. The tape provides a resistive path to dissipate the energy of an ESD event.

An igniter with static discharge element and ferrite sleeve is described by Joseph Barrett in U.S. Pat. No. 4,422,381 (1983). The assembly essentially consists of a ferrite bead attenuator packaged in the support sleeve of the EED along with a spark gap arrester. The ferrite beads attenuate stray RF while the spark gap arrester provides a means of protection from ESD as previously described.

K. Schoenwald describes a method of fabricated a filter on a substrate utilizing thick film technology in German patent P 35 02 526.3 (1984). In this structure the filter is fabricated in a planar fashion via strip conductor technology.

An electric initiator resistant to actuation by radio frequency and electrostatic energies is described by Klaus Rucker in U.S. Pat. No. 4,517,895 (1985). The configuration consists of a filter having series and shunt resistive elements and a spark gap arrestor built in at the input leads of the package.

A filter/shield for electroexplosive devices is described by Marvin Shores in U.S. Pat. No. 4,592,280 (1986). The configuration consists of feedthrough filters used in conjunction with a shield to provide protection from electromagnetic interference.

An integrated filtered and shielded ignition assembly is described by Leon Riley and Gerald Smith in U.S. Pat. No. 4,779,532 (1988). The configuration consists of a metallic canister which surrounds the EED used in conjunction with feedthrough filters to provide RF immunity.

The previously mentioned combinations of filters and spark gap assemblies have a number of limitations. There are an ever increasing number of cases when conventional passive filters provide inadequate EMI protection or do not meet size, durability, cost, or other requirements. This condition is especially acute on naval surface ships, as was alluded to earlier.

Conventional filters are usually constructed from standard passive components assembled on printed circuit boards or wired within a metal chassis with size minimization being of secondary importance. However, a physical requirement that is often placed on a filter and which is difficult to achieve is the allowable size it may occupy. Size limitations can be and often are a major consideration for filters used in conjunction with EED related weapons systems. Therefore, a conventional filter may simply be too large for some applications.

Another factor that enters into filter selection, especially if large scale installation of the device is involved, is the cost of the device. Even through filters have few components, the cost of assembly may result in per unit prices that are relatively high in comparison to the cost of an EED.

Additionally, conventional filters are designed to freely transmit DC signals when used in conjunction with an EED since fire control signals are DC. Thus, a conventional filter is useless in attenuating low frequency signals due to rectification of RF signals.

Shielding of an EED is effective only if construction of the barrier and operational procedures can guarantee the integrity of the structure. This can be difficult if a large volume of devices is regularly expended as the chance of a procedural error increases as the number of times it is performed increases.

In a conventional filter system where the filter and EED and essentially two separate stages, a non-propagating magnetic field may induce an EMF via closed loop induction. This situation may result in a hazard to the ordnance.

A spark gap arrestor relies upon precise spacing of electrodes to assure that a static discharge is shunted to ground. The mechanics of constructing the precise air gaps can involve expensive manufacturing techniques.

An object of the present invention is to provide a novel device which can be utilized to initiate any EED, including military ordinance, blasting caps, squibs, impulse cartridges and other devices. The common theme which readily becomes apparent when reviewing past art in the area of insensitive EEDs is that a variety of techniques has been developed to protect a sensitive bridgewire from interfering signals. The problem of the sensitive bridgewire still exists, it is simply embedded in a protective circuit. Difficulties associated with these circuits have been previously mentioned.

The present invention describes an ignition element which exhibits an insensitivity to stray RF arcing, and ESD in comparison with conventional devices. The insensitivity of the structure is controllable by changing processing parameters during fabrication. The degree of insensitivity can be altered in a convenient fashion during fabrication to tailor the device to a specific application. The structure does not require any external elements to operate, although it may be prudent to include additional protection. The basic idea is that a device cannot be "excessively" insensitive and safe.

The present invention offers numerous advantages. Since the structure will typically be a monolithic, solid state device, it is extremely reliable. There exist no wires to break due to mechanical vibration or shock. The firing characteristics of the element are variable. It can be designed to ignite at various energy levels (voltage × current × time). As such, ignition can be made to occur extremely fast. The sensitivity of the invention can be established such that it is immune to ESD events without reliance upon external spark gaps. The invention is immune to stray RF signals as the major equivalent circuit elements are capacitive reactances and do not dissipate heat when RF power is coupled to them. The invention is simple to fabricate using well established microelectronic techniques. Microelectronic fabrication was developed to produce large quantities of essentially identical circuits and structures. The simplicity of construction results in a low cost of production. Furthermore, the leakage current through the pn junctions of the type typically involved in semiconductor technology results in the capability to interrogate the element with a low-level DC signal to verify continuity in the firing control circuit prior to actually firing the device.

It is realized that a variety of configurations of semiconductors and other materials utilizing various geometrical shapes are possible. Three configurations will be described in detail accompanied by a discussion of the general principles relating to various configurations of the invention.

DETAILED DESCRIPTION OF THE INVENTION

Figure 1:
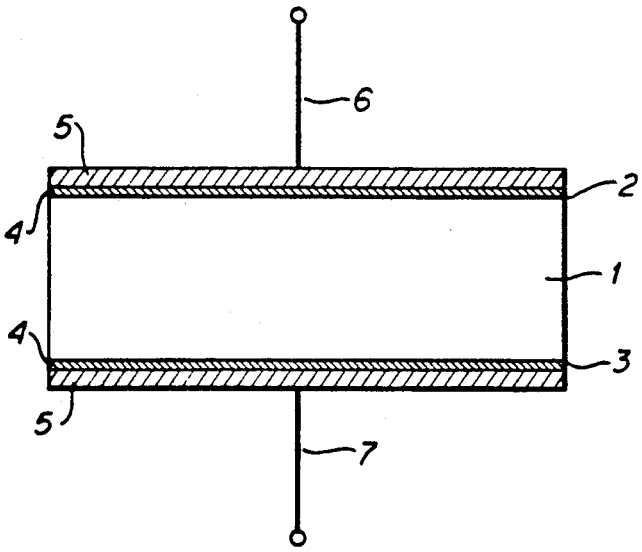
FIG. 1 is a pictorial representation, not necessarily to scale, of a silicon or other semiconductor wafer which has been prepared for use in the present invention.
Figure 2:
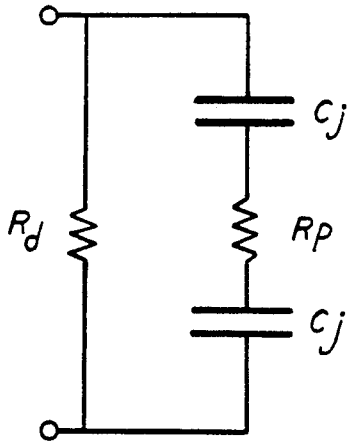
FIG. 2 is a schematic diagram showing the electrical circuit equivalent of the configurations depicted in the other Figures.

FIG. 1 shows a simple embodiment of the invention. The starting material for the structure is a thin n-type silicon or other semiconductor wafer 1 polished on both sides. The wafer is cleaned and inserted in a diffusion furnace to allow for a p-type dopant to diffuse into the top 2 and bottom 3 of the wafer. Alternatively, a pre-doped material could be affixed to the respective surfaces of the wafer. In either case, this forms a p-n junction on the top and bottom of the wafer. A p-n junction possesses a parasitic junction capacitance which exists on both surfaces of the metallurgical junction. The value of this capacitance is dependent on the cross-sectional area of the junction, doping density of the semiconductor, and other known factors. Metal is then affixed to the top and bottom of the wafer. A thin layer of chromium 4 is first deposited followed by a much thicker layer of copper 5. The chromium 4 provides for adhesion between the surface of the silicon wafer 1 and the copper 5. Copper is used as an overlayer since is provides good solderability. A variety of other metals could have been used to fulfill the criterion of adhesion and solderability. The wafer can then be sawed into small squares and leads 6 and 7 may be attached. Wafers are typically on the order of 25 mils thick, and are typically subdivided, after preparation as set forth above, into small squares on the order of 75 mils width. The electrical circuit equivalent of the structure is shown in FIG. 2. The circuit consists of two capacitors $C_j$ and two resistors $R_p$ and $R_d$. The capacitors represent the parasitic junction capacitance. Resistor $R_p$ represents the parasitic resistance of the silicon wafer. $R_d$ represents the resistance associated with the leakage current which flows through the p-n junctions at low voltage input.

At RF frequencies the impedance of the structure appears essentially as a reactance consisting of the series combination $C_j$ and $J_j$. It is noted that a capacitor does not dissipate real power. Therefore, the structure heats only due to the parasitic coupling of $R_p$.

Since the thermal conductivity of silicon is not poor, the structure can be mounted on a highly thermally conductive holder, such as metal, so that a heat sink is formed. This allows for any heat which is dissipated by $R_p$ to be shunted away so that the temperature of the igniter remains low.

There exist two distinct mechanisms which will cause EED ignition. In the structures described, both mechanisms are integrated onto the structure to provide redundancy in firing the device. The reason for this is that a device cannot be made "excessively" reliable when it comes to firing.

The first mechanism involves applying a voltage across a pn junction which exceeds the breakdown voltage. The pn junction which is reverse biased absorbs power equal to the product of $V_B \times I$. Power integrated over time is the energy absorbed by the surface of the wafer. The mechanism of heat absorption via electrons crossing a potential barrier is referred to as the Peltier effect. The heat capacity of a material is defined as the ratio of energy to temperature $$C_v = Q/T.$$

A temperature rise of the volume of the surface of the wafer can be expected to be proportional to energy coupled to heat capacity $$\text{The energy coupled is} = V \times I \times time.$$

The invention can be precisely tailored to a given fire control signal for time, voltage, and current levels. This is a capability unique to the invention and not presently offered by any other technology.

The second method of firing involves applying an electric field across a dielectric material which exceeds the dielectric strength of the material. The applied field causes the material to breakdown, and charge carriers can freely flow from one electrode to the other. The charge flow will result in an arc forming in the proximity of the flowing charge. The arc produces temperatures of several thousand degrees Kelvin where the charge flow concentrates. This event also causes a catastrophic mechanical change in the material such as deformation due to excessive heating (i.e., mechanical shock). This event of breakdown is extremely fast and the temperature and/or shock can be used to ignite an EED. The voltage at which this event occurs is directly proportional to the thickness of the dielectric layer used between the electrodes of the element. Thus, the phenomena can be tailored to a specific voltage/fire control supply requirement.

To illustrate flexibility in geometrical considerations, two other configurations, of many possible configurations, will be described, one of which ignites at or near to the edge of the chip, and the other of which ignites in the center of the chip.

Figure 3:
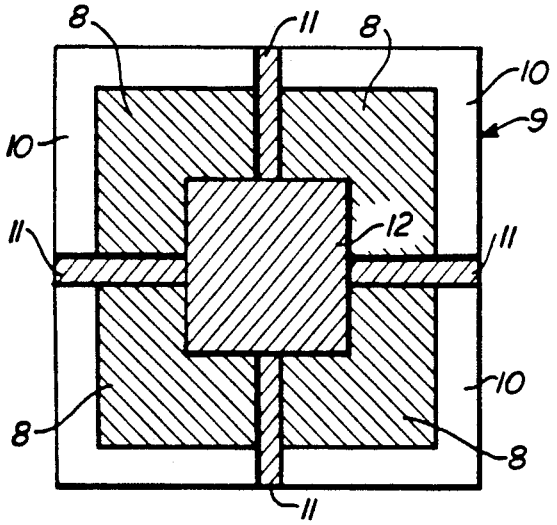
FIG. 3 is a pictorial representation of an alternative embodiment of the present invention, not necessarily to scale, showing a view of the top of a silicon or other semiconductor wafer, prepared in an alternative manner for use in the present invention.

An edge igniter configuration is shown in FIG. 3. In this embodiment, an oxide or other dielectric layer 8 has been implaced on the top surface of a silicon or other semiconductor wafer 9. The oxide layer 8 has been removed from the edge of the wafer inward a short distance as shown creating an oxide-free border 10. The oxide layer 8 has likewise been removed from a point near the center of the wafer extending outwardly forming corridors 11 to the edge of the wafer. In the configuration as shown in FIG. 3, four corridors are shown and the border from which the oxide has been removed extends around the entire periphery of the wafer. In practice, the number of corridors, the width of the border and the extent of the border may each be varied to modify performance characteristics of the electroexplosive device.

The wafer has been cleaned and inserted into a diffusion furnace to allow for a p-type dopant to diffuse into the exposed surface of the wafer in the corridors. At the point of contact between the dopant and the wafer, there is formed a p-n junction.

Next, a conducting material, such as a metal, is deposited over the entire surface of the configuration as described above. The metal is then removed from all areas except the area above the corridors and a capacitor-functioning metal region 12 in the center of the wafer.

As shown in FIG. 3, the result of the above steps is to produce a surface area characterized by a border 10, corridors 11, a capacitor-functioning metal region 12 and exposed oxide areas 8. The opposite side of the wafer is configured as described above for the bottom side of FIG. 1. An electrical lead joins the metal region 12 on the one side of the wafer and another lead joins the exposed, outer metal, or conducting material, surface on the opposite side.

Once the voltage applied across the wafer exceeds the threshold level required for overcoming the potential difference at the p-n junctions (which occur at numerous points along the corridors 11 and the border 10), a current will flow across the silicon causing extreme heat in the vicinity, essentially vaporizing the EED, and causing ignition of the pyrotechnic material in contact with the EED. Such current flow takes place initially at the point of lowest potential difference across the wafer wherever that may occur based on thicknesses of the wafer, doping, and other factors which may vary slightly from EED to EED. However, once the current begins flowing across the wafer at any of the many points where this can occur, ignition will occur very rapidly thereafter, and it is largely immaterial where the current flow begins.

Using FIG. 3 as a reference, one can imagine many variations, including use of corridors without borders, use of corridors of varying numbers, use of smaller border areas and the like. Such variations will be selected, depending on the relative sensitivity to ignition sought. Obviously, there are slight variations and imperfections in every manufacturing process, and ignition might not occur at precisely the desired voltage levels if there are a relatively small number of points at which current can flow across the wafer. By increasing the numbers of such points by means of multiple corridors and borders, the variations in EEDs resulting from the manufacturing process can be minimized and predictability and reliability accordingly improved. Of course, the corridors and borders, the variations in EEDs resulting from the manufacturing process can be minimized and predictability and reliability accordingly improved. Of course, the corridors and borders must be relatively narrow so as to concentrate charge sufficient to overcome the potential difference required to effect current flow and subsequent ignition.

Another way to achieve ignition using the basic configuration in FIG. 3 would be to produce an EED having considerably thinner layers of oxide or other dielectric at one or more corners of the metal region 12. In such case, the dielectric represented in FIG. 3 by the oxide layer 8 breaks down once the potential at the corner of the metal region exceeds the dielectric strength of the thinner oxide layer beneath it, having thickness of the order of magnitude of approximately 0.1 microns at the critical corners. Of course, if one were relying on the dielectric breakdown to produce ignition, the corridors 11 and borders 10 would be necessary. However, it would be possible, and conceivably desirable, to configure an EED having both the corridors 11 and border 10, on the one hand, and the thinner oxide (or other dielectric) at the corners of the metal region 12, on the other hand.

Figure 4:
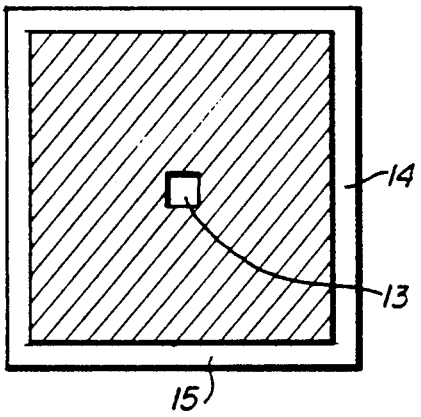
FIG. 4 is a pictorial representation of yet another alternative embodiment of the present invention, not necessarily to scale, showing a view of the top of a silicon or other semiconductor wafer, prepared in yet another alternative manner for us in the present invention.

Another embodiment of the invention is shown in FIG. 4. In this configuration, the center 13 of the silicon or other semiconductor wafer 14 is designed to ignite. A small p-n junction is formed on the top surface of the center 13 which is surrounded by a region of oxide or other dielectric 15, upon which is deposited a metal or other conducting material extending up to a border on the periphery of the wafer.

Figure 5:
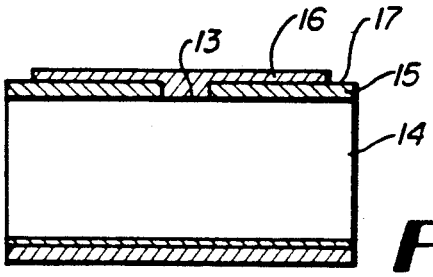
FIG. 5 is a pictorial representation, not necessarily to scale, of a side or edge of the silicon or other semiconductor wafer depicted in FIG. 4.

FIG. 5 shows a side view of the configuration shown in FIG. 4. FIG. 5 shows the silicon or other semiconductor wafer 14 with a doped center 13 of the top of the wafer, with a thick oxide or other dielectric layer 15 surrounding the periphery of center 13 and a metal or other conductive layer 16 covering the thick oxide layer 15 except for a border area 17 around the periphery of the wafer, and extending to the center 13. The bottom of the wafer 14 is configured in the manner described for the bottom of the wafer in FIG. 1.

Upon application of a sufficient voltage, the p-n junction at the doped center breaks down and heats as current passes through it. The voltage can be selected and changed by variations in doping, thickness of wafer (and the depth of etching into the wafer, if any, at center 13), types of materials and other factors. Leaving an oxide or other dielectric border around the periphery of the surface helps prevent inadvertent arcing of electric charge in an uncontrolled manner outside the center wafer 14 and directs current flow through wafer 14 at center 13. This safeguard against arcing tends to make the design of FIGS. 4 and 5 superior to the design of FIG. 3.

The phenomenon of heat absorption by carriers crossing a potential barrier is not limited to semiconductor. Dissimilar metals which are brought into intimate contact are one such example. At equilibrium, the total energies of conduction electrons at the Fermi level are equal; nevertheless, the internal energies of the conduction band electrons remain the same. This phenomenon is the fundamental mechanism by which thermocouples work.

Metal semiconductor junctions are also routinely utilized to form a potential barrier in a solid state system, this being commonly referred to as a "Schottky" barrier. $Pd_2Si$, $NiSi_2$ and $TiSi_2$ are common examples of silicides which are used to fabricate such a structure.

There exist certain classes of ceramic materials (e.g. zinc oxide) which exhibit a non-linear resistance as a function of input voltage. A layer of the material appears as a high resistance at low voltages but possesses a dynamic resistance $\delta V/\delta I$ which approaches a very small value past a particular reference voltage. Such a material could be configured as a ignition element although the dielectric properties of the material may make it difficult to work with.

It also noted that a variety of configurations involving various geometries and materials could be used with the described igniter. The metals which are used to make contact need only adhere to the surface and provide a low resistivity contact. The substrate doping could easily be p-type with a corresponding change in the diffusion to n-type. The junction could be formed by implanting the dopants via ion implantation. The dielectric materials used could be polyamide, silicon nitride, sputtered quartz or any other dielectric material having similar properties. The doping levels used in the structure could vary considerably and the structure would still function. The variations could be from intrinsic silicon (no dopant) to supersaturation of the silicon lattice (concentration of impurities exceeds the solid solubility of silicon). Any semiconductor (e.g. germanium, gallium arsenide) could be utilized as the substrate. The combination of materials and configurations should be selected with regard to the result sought to be achieved. For example, if it is desired to have greater protection against inadvertent ignition, the materials and configuration can be selected to produce a greater voltage barrier. If ignition at lower thresholds is desired, that result can also be achieved through proper selection of materials and configurations.

What is claimed is:

1. An electroexplosive device comprising:

a semiconductor having its top and bottom surfaces treated by adding a controlled amount of one or more dopants so that a difference in Fermi levels is established between the surfaces and the inner substrate of the semiconductor; and, a means of applying electrical energy across the energy barrier resulting from the difference in said Fermi levels.

2. An electroexplosive device as described in claim 1 wherein a conducting material has been implaced on both the bottom and top doped surfaces of said semiconductor.

3. An electroexplosive device as described in claim 1 wherein, a conducting material has been implaced on both the bottom and top doped surfaces of said semiconductor except for an arbitrarily wide border area about the periphery of at least one of said surfaces.

4. An electroexplosive device comprising a semiconductor wafer on the first surface of which has been affixed:

(i) a dielectric layer which covers said first surface of the wafer, except for an arbitrarily wide border area along at least one edge and except for an arbitrarily wide corridor extending from a point arbitrarily near the center of said wafer to said edge;

(ii) a p-type dopant diffused into the exposed areas of the said first surface of the wafer in said corridor and along said edge, forming a p-n junction between said dopant and said exposed surfaces of the said wafer; and (iii) a conducting material deposited in the area of the corridor doped as set forth in (ii) above and on an arbitrarily sized and configured area in or about the center of said wafer; and on the opposite surface of which wafer a p-type dopant has been diffused into the wafer, upon which a conducting material has been deposited.

5. An electroexplosive device as described in claim 4 wherein multiple corridors extending in arbitrary directions to one or more edges of said first surface of the wafer have been prepared and treated in the manner set forth for the single corridor as described in claim 4.

6. An electroexplosive device as described in claim 4 wherein an arbitrarily wide border extending about the periphery of said first surface of the wafer has been prepared and treated in the manner set forth for the said edge as described in claim 4.

7. An electroexplosive device as described in claim 4 wherein:

(i) multiple corridors extending in arbitrary directions to one or more edges of said first surface of the wafer have been prepared in the manner set forth for the single corridor as described in claim 4; and (ii) an arbitrarily wide border extending about the periphery of said first surface of the wafer has been prepared and treated in the manner set forth for the said edge as described in claim 4.

8. An electroexplosive device comprising a semiconductor wafer on the first surface of which:

(i) an arbitrarily sized and configured area about the center thereof has had a p-type dopant diffused thereon and therein, surrounded by a dielectric material extending to the periphery of said first surface of the wafer; and (ii) a conductive material has been deposited in the said center area extending also over the said dielectric material except for an arbitrarily wide border about the periphery of said dielectric material; and on the opposite surface of which wafer a p-type dopant has been diffused into the wafer, upon which a conducting material has been deposited.

* * * * *